US010280019B2

(12) United States Patent
Takai

(10) Patent No.: US 10,280,019 B2
(45) Date of Patent: May 7, 2019

(54) PAPER FEEDER THAT DETERMINES NECESSITY OF REPLACEMENT OF RETARD ROLLER, AND IMAGE FORMING APPARATUS

(71) Applicant: Kyocera Document Solutions Inc., Osaka (JP)

(72) Inventor: Hiroaki Takai, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/963,125

(22) Filed: Apr. 26, 2018

(65) Prior Publication Data

US 2018/0312353 A1 Nov. 1, 2018

(30) Foreign Application Priority Data

Apr. 26, 2017 (JP) ..... 2017-087251

(51) Int. Cl.

| | |
|---|---|
| ***B65H 3/52*** | (2006.01) |
| ***B65H 3/06*** | (2006.01) |
| ***B65H 1/08*** | (2006.01) |
| ***B65H 7/18*** | (2006.01) |
| ***B65H 5/06*** | (2006.01) |

(Continued)

(52) U.S. Cl.

CPC ..... *B65H 3/5261* (2013.01); *B65H 1/08* (2013.01); *B65H 3/0607* (2013.01); *B65H 3/0676* (2013.01); *B65H 3/5215* (2013.01); *B65H 5/062* (2013.01); *B65H 7/06* (2013.01); *B65H 7/14* (2013.01); *B65H 7/18* (2013.01); *B65H 2404/193* (2013.01); *B65H 2511/33* (2013.01); *B65H 2511/417* (2013.01); *B65H 2513/40* (2013.01); *B65H 2553/51* (2013.01)

(58) Field of Classification Search

CPC ..... B65H 3/5261; B65H 7/06; B65H 7/12; B65H 2553/51

See application file for complete search history.

(56) References Cited

U.S. PATENT DOCUMENTS

| | | | | |
|---|---|---|---|---|
| 8,292,295 | B2 * | 10/2012 | Ohshima | B65H 7/02 271/265.01 |
| 10,054,890 | B2 * | 8/2018 | Ochi | G03G 15/6502 |
| 2017/0166411 | A1 * | 6/2017 | Kawarago | B65H 3/0669 |

FOREIGN PATENT DOCUMENTS

| | | | |
|---|---|---|---|
| JP | 09235032 | A * | 9/1997 |
| JP | 11130296 | A * | 5/1999 |
| JP | 2010-208795 | A | 9/2010 |

* cited by examiner

*Primary Examiner* — Jeremy R Severson
(74) *Attorney, Agent, or Firm* — HEA Law PLLC

(57) ABSTRACT

A paper feeder includes a lift plate, a pickup roller, a feed roller, a retard roller, a rotation-count detection sensor, and a control unit. The rotation-count detection sensor outputs a rotation-count detection signal. The rotation-count detection signal indicates a rotation count of the retard roller. The control unit detects the rotation count of the retard roller based on the rotation-count detection signal. The lift plate separates from the pickup roller before the control unit detects the rotation count of the retard roller. The feed roller is driven when the control unit detects the rotation count of the retard roller. The retard roller is in abutting contact with the feed roller when the control unit detects the rotation count of the retard roller. The control unit determines whether replacement of the retard roller is necessary or not, based on the detected rotation count of the retard roller.

9 Claims, 6 Drawing Sheets

(51) Int. Cl.
*B65H 7/06* (2006.01)
*B65H 7/14* (2006.01)

PAPER FEEDER THAT DETERMINES NECESSITY OF REPLACEMENT OF RETARD ROLLER, AND IMAGE FORMING APPARATUS

INCORPORATION BY REFERENCE

This application is based upon, and claims the benefit of priority from, corresponding Japanese Patent Application No. 2017-087251 filed in the Japan Patent Office on Apr. 26, 2017, the entire contents of which are incorporated herein by reference.

BACKGROUND

Unless otherwise indicated herein, the description in this section is not prior art to the claims in this application and is not admitted to be prior art by inclusion in this section.

An image forming apparatus generally includes a paper feeder that houses a plurality of sheets. The paper feeder includes a feed roller and a retard roller. The feed roller sends out sheets from the paper feeder. The retard roller is in abutting contact with the feed roller to prevent multi feeding of the sheets.

The feed roller and the retard roller need to be replaced when a rotation count of the retard roller becomes equal to or less than a certain ratio with respect to the rotation count of the feed roller. This is because the sheets might not be conveyed due to a shortage of rotation of the retard roller even when multi feeding of the sheets does not occur. In other words, this is because a jam easily occurs. Reduction of the rotation count of the retard roller is mainly caused by an abrasion of the retard roller.

A replacement timing (a lifetime) of the retard roller can be determined by detection of the rotation count of the retard roller. For example, there is proposed a sheet conveyance apparatus that identifies which of a feed roller (a feed roller) and a separation roller (a retard roller) is deteriorated up to near its lifetime.

Specifically, the above-described sheet conveyance apparatus includes a Hall element, a velocity sensor, and a control unit. The control unit detects a cumulative rotation angle (a rotation count) of the separation roller per one paper feeding operation based on an output of the Hall element. The velocity sensor detects a moving velocity of the sheet sent out by the feed roller. The control unit determines which of the feed roller and the separation roller is deteriorated up to near its lifetime based on the cumulative rotation angle of the separation roller and detection results by the velocity sensor.

SUMMARY

A paper feeder according to one aspect of the disclosure includes a lift plate, a pickup roller, a feed roller, a retard roller, a rotation-count detection sensor, and a control unit. The lift plate accommodates a plurality of sheets. The pickup roller feeds out the plurality of sheets placed on the lift plate one by one. The feed roller sends out the sheets that the pickup roller has fed out. The retard roller separates a subsequent sheet from the sheet that has precedingly reached the feed roller when two or more of the sheets are fed out in an overlapped state by the pickup roller. The rotation-count detection sensor outputs a rotation-count detection signal. The rotation-count detection signal indicates a rotation count of the retard roller. The control unit detects the rotation count of the retard roller based on the rotation-count detection signal. The lift plate separates from the pickup roller before the control unit detects the rotation count of the retard roller. The feed roller is driven when the control unit detects the rotation count of the retard roller. The retard roller is in abutting contact with the feed roller when the control unit detects the rotation count of the retard roller. The control unit determines whether replacement of the retard roller is necessary or not, based on the detected rotation count of the retard roller.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
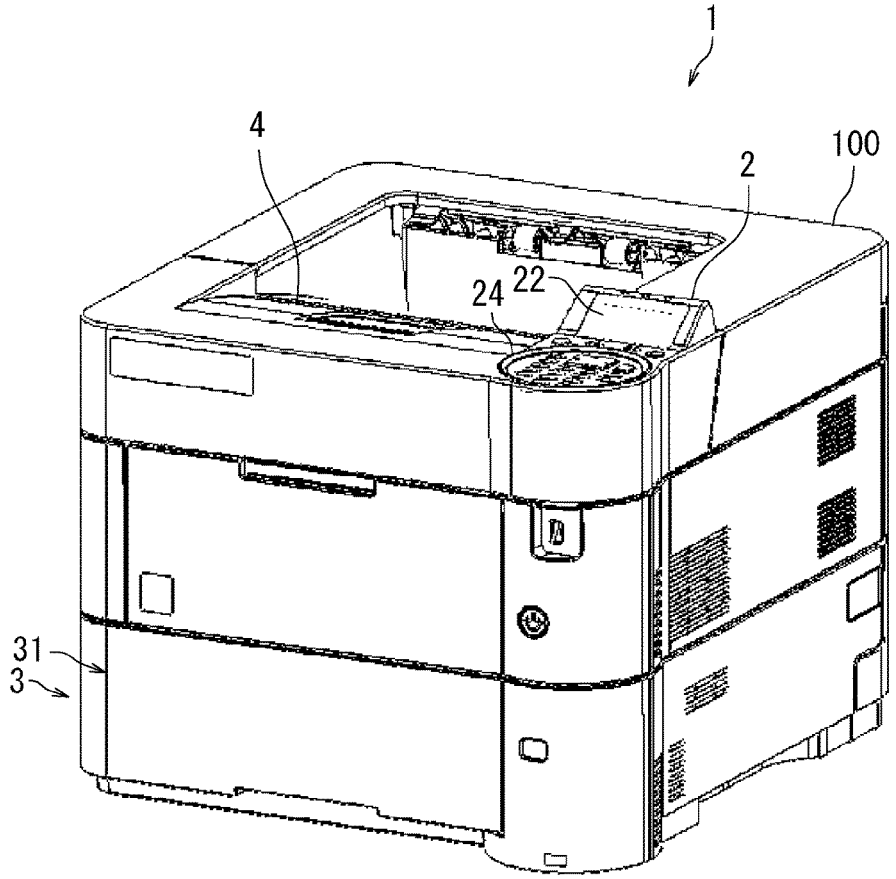
FIG. 1 obliquely illustrates an external appearance of an image forming apparatus according to an embodiment 1 of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes embodiments of the disclosure with reference to the drawings. However, the disclosure is not limited to the embodiments described below. In the drawings, identical reference numerals are used to identical or corresponding parts not to repeat explanations.

Embodiment 1

First, a description will be given of a basic configuration of an image forming apparatus 1 according to the embodiment with reference to FIGS. 1 and 2. FIG. 1 obliquely illustrates an external appearance of the image forming apparatus 1 according to the embodiment. In the embodiment, the image forming apparatus 1 is an electrophotographic-method printer.

As illustrated in FIG. 1, the image forming apparatus 1 includes an operation panel 2, a paper feeder 3, a discharge tray 4, and a housing 100.

The operation panel 2 includes a display apparatus 22 and operation keys 24 (hardware keys). The display apparatus 22 displays various kinds of setting screens. The display apparatus 22 displays various kinds of error notification screens. The error notification screen is displayed when an error is generated in the image forming apparatus 1. The error notification screen notifies a type of the error. The error notification screen notifies a method to cancel the error. The operation keys 24 accept instructions to the image forming apparatus 1 from a user. The display apparatus 22 may be a touch panel. When the display apparatus 22 is a touch panel, the display apparatus 22 accepts the instruction to the image forming apparatus 1 from a user.

The housing 100 houses the paper feeder 3. The paper feeder 3 includes a cassette 31 that is removably attachable to the housing 100. The cassette 31 houses a plurality of sheets S. The image forming apparatus 1 forms images on the sheets S sent out from the paper feeder 3. The sheets S to which an image is formed are discharged into the discharge tray 4. In the embodiment, the discharge tray 4 is formed in an upper portion of the housing 100.

Figure 2:
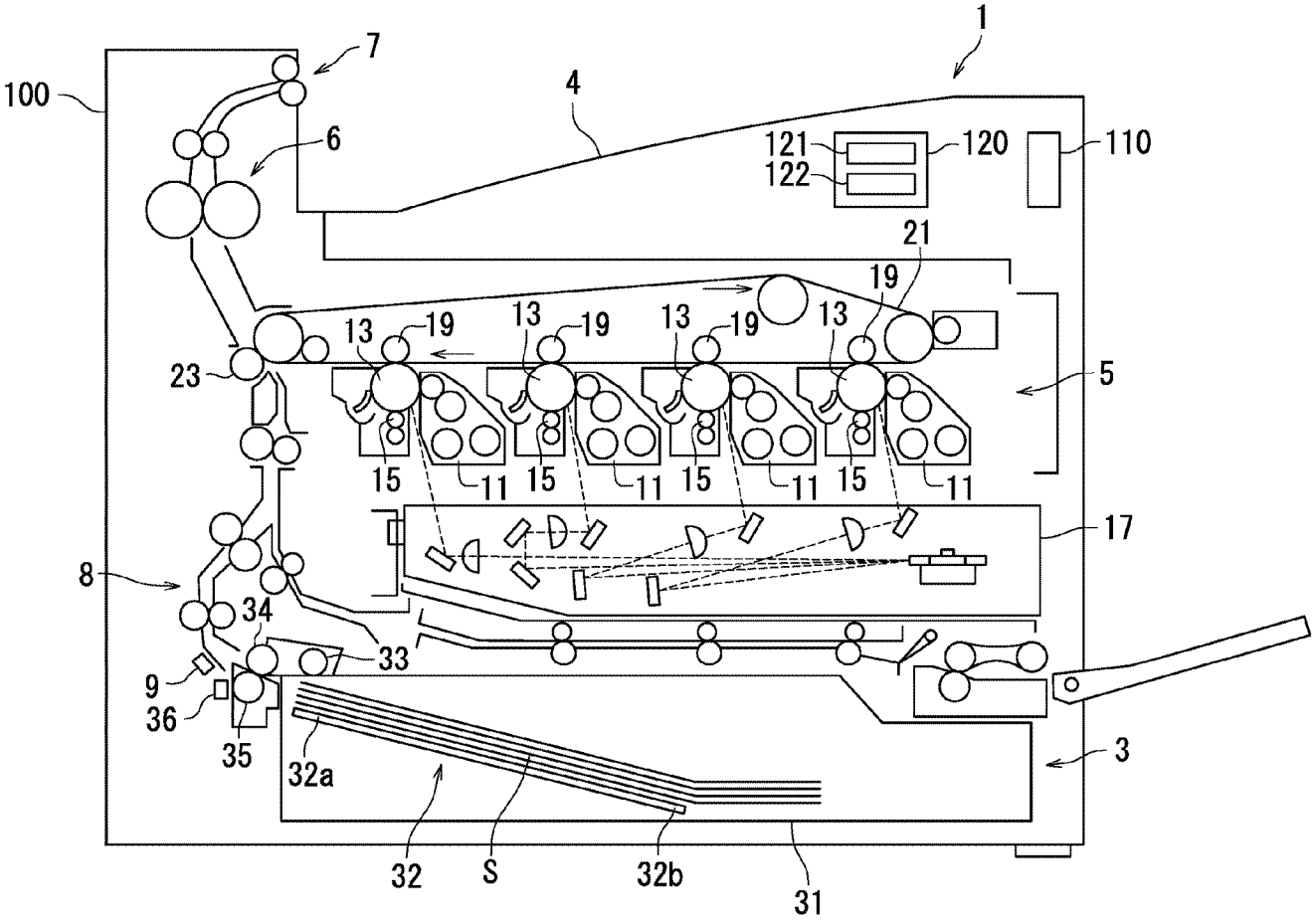
FIG. 2 illustrates a configuration of the image forming apparatus according to the embodiment 1.

FIG. 2 illustrates a configuration of the image forming apparatus 1 according to the embodiment. As illustrated in FIG. 2, in addition to the operation panel 2 and the paper feeder 3 described with reference to FIG. 1, the image forming apparatus 1 further includes an image forming unit 5, a fixing unit 6, a discharge device 7, a sheet conveyance apparatus 8, a sheet-rear-end detection sensor 9, a communication unit 110, and a control unit 120. The housing 100, in addition to the paper feeder 3, houses the image forming unit 5, the fixing unit 6, the discharge device 7, the sheet conveyance apparatus 8, the sheet-rear-end detection sensor 9, the communication unit 110, and the control unit 120.

The image forming unit 5 includes developing devices 11, image carriers 13, charging apparatuses 15, an exposure apparatus 17, primary transfer rollers 19, an intermediate transfer belt 21, and a secondary transfer roller 23.

In the embodiment, the image forming apparatus 1 is a tandem type, and the developing devices 11 house developers the colors of which are mutually different.

The image carrier 13 holds an electrostatic latent image on its surface (its circumference surface). To the electrostatic latent image, a toner for electrostatic-latent-image development (hereinafter simply referred to as "a toner") contained in the developer is supplied from the corresponding developing device 11. Specifically, the toner is electrically attracted to the electrostatic latent image. This forms a toner image on the surface of the image carrier 13. The image carrier 13 is typically a photoreceptor drum.

The charging apparatus 15 is located in a peripheral area of the image carrier 13 to uniformly charge the surface of the image carrier 13. The charging apparatus 15 is not particularly limited insofar as it is a device that is able to uniformly charge the surface of the image carrier 13 and may be a contact type charger or a non-contact type charger.

The exposure apparatus 17 exposes the surfaces of the image carriers 13 that are uniformly charged to form the electrostatic latent images on the surfaces of the image carriers 13. The exposure apparatus 17 is, for example, a laser scanning unit.

The primary transfer roller 19 is opposed to the image carrier 13 across the intermediate transfer belt 21. Specifically, the primary transfer roller 19 forms a primary transfer nip portion with the image carrier 13. The primary transfer roller 19 transfers the toner images (the toner images formed on the surfaces of the image carriers 13) to the intermediate transfer belt 21 at the primary transfer nip portion.

The intermediate transfer belt 21 is typically an endless belt and is spanned across a plurality of rollers. At least one of the plurality of rollers is a drive roller. The drive roller is driven by, for example, a motor to cause the intermediate transfer belt 21 to rotate (annularly travel) in a direction indicated by arrows.

The secondary transfer roller 23 transfers the toner images, which have been transferred onto the intermediate transfer belt 21, onto the sheet S. Specifically, the secondary transfer roller 23 is opposed to one of the rollers arranged inside the intermediate transfer belt 21 across the intermediate transfer belt 21. The secondary transfer roller 23 forms a secondary transfer nip portion with the opposite roller. By the sheet S passing through the secondary transfer nip portion, the toner images are transferred onto the sheet S.

The fixing unit 6 fixes the toner images, which have been transferred onto the sheet S, to the sheet S. Specifically, the fixing unit 6 includes a heating member and a pressure member. The heating member heats the sheet S, and the pressure member presses the sheet S. This fixes the toner images to the sheet S.

The discharge device 7 discharges the sheet S, to which the toner images are fixed, into the discharge tray 4. The discharge device 7 typically includes a discharge roller pair. The sheet S is discharged into the discharge tray 4 by the rotating discharge roller pair.

The sheet conveyance apparatus 8 conveys the sheet S sent out from the paper feeder 3 up to the discharge device 7. For details, the sheet S is conveyed up to the discharge device 7 via the secondary transfer nip portion and the fixing unit 6 in this order. The sheet conveyance apparatus 8 includes a plurality of guide plates and a plurality of roller pairs, and the plurality of guide plates form a sheet conveying path. The plurality of roller pairs are arranged along the sheet conveying path. The sheet S is conveyed along the sheet conveying path by the plurality of roller pairs, which rotate.

The sheet-rear-end detection sensor 9 detects the rear end of the sheet S. Specifically, the sheet-rear-end detection sensor 9 outputs a signal that indicates that the rear end of the sheet S has passed through a predetermined position. For details, the sheet-rear-end detection sensor 9 is arranged on an upstream side of the sheet conveying path to output a signal that indicates that the sheet S has been sent out from the paper feeder 3 (the sheet S has been separated from the paper feeder 3). The sheet-rear-end detection sensor 9 is typically a transmission-type optical sensor or a reflection-type optical sensor. The signal generated by the sheet-rear-end detection sensor 9 controls an interval (a paper feeding interval) of sending out the sheet S from the paper feeder 3.

The communication unit 110 is connected to an external device such that data communications are possible to obtain image data from the external device. For example, the communication unit 110 is a network interface such as a local area network (LAN) board. The external device is, for example, a general-purpose computer such as a personal computer. The communication unit 110 may have a configuration that executes wireless communication with the external device. A wireless communication method may be a short range wireless communication method such as Bluetooth®.

The control unit 120 controls operations of respective units of the image forming apparatus 1. Specifically, the control unit 120 controls the operations of the operation panel 2 (see FIG. 1), the paper feeder 3, the image forming unit 5, the fixing unit 6, the discharge device 7, the sheet conveyance apparatus 8, the sheet-rear-end detection sensor 9, and the communication unit 110. For example, the control unit 120 controls the operations of the respective units of the image forming apparatus 1 such that an image is formed on the sheet S, based on the image data obtained by the communication unit 110. The control unit 120 controls the paper feeding interval based on the output of the sheet-rear-end detection sensor 9.

In the embodiment, the control unit 120 includes a processing unit 121 and a storage unit 122. The processing unit 121 is a control instrument that performs various processing such as numerical calculation, information processing, or apparatus control by executing the programs stored in the storage unit 122. The storage unit 122 stores control programs for controlling the operations of the respective units of the image forming apparatus 1.

The processing unit 121, for example, executes image processing with respect to the image data after causing the storage unit 122 to store the image data obtained by the communication unit 110. This stores the image data for printing into the storage unit 122. The processing unit 121 controls the operations of the respective units of the image forming apparatus 1 such that an image is formed on the sheet S based on the image data for printing.

The processing unit 121 includes an arithmetic circuit, such as a central processing unit (CPU) or a micro-processing unit (MPU). The processing unit 121 may include an integrated circuit for image processing. The integrated circuit for image processing is typically configured as an application specific integrated circuit (ASIC).

The storage unit 122 stores data about screens, in addition to the control programs. The data about the screen includes, for example, various kinds of layout image data. The processing unit 121 causes the display apparatus 22 (see FIG. 1) to display various kinds of screens based on the data about the screen. The storage unit 122 is configured as, for example, a hard disk drive (HDD), a random-access memory (RAM), and a read-only memory (ROM).

Subsequently, a description will be given of the paper feeder 3 according to the embodiment. The paper feeder 3 further includes a lift plate 32, a pickup roller 33, a feed roller 34, a retard roller 35, and a rotation-count detection sensor 36, in addition to the cassette 31.

The lift plate 32 is arranged inside the cassette 31. The lift plate 32 accommodates a plurality of sheets S. The lift plate 32 includes an end portion 32*a* close to the pickup roller 33 and an end portion 32*b* far from the pickup roller 33. In the following, the end portion 32*a* close to the pickup roller 33 is described as "a distal end portion 32*a*," and the end portion 32*b* far from the pickup roller 33 is described as "a base end portion 32*b*." The pickup roller 33 is arranged above the distal end portion 32*a*.

The lift plate 32 operates such that at least the distal end portion 32*a* moves up and down. In other words, the lift plate 32 operates such that the distal end portion 32*a* approaches to and separates from the pickup roller 33.

In the embodiment, the lift plate 32 turns (swings) around the base end portion 32*b* based on a driving power generated from a motor (hereinafter referred to as "a lift motor"). Specifically, the lift plate 32 turns such that the distal end portion 32*a* approaches to the pickup roller 33 when the cassette 31 is housed (set) inside the housing 100. As a result, the distal end portion 32*a* of the lift plate 32 is raised to cause the sheet S to be in contact with the pickup roller 33. When the cassette 31 is extracted from the housing 100, the lift plate 32 turns such that the distal end portion 32*a* is separated from the pickup roller 33 by its own weight. As a result, the distal end portion 32*a* moves downward to cause the sheet S to be separated from the pickup roller 33.

The pickup roller 33 picks up (feeds out) the sheets S placed on the lift plate 32 one by one, and the feed roller 34 sends out the sheet S picked up by the pickup roller 33. In the embodiment, the feed roller 34 rotates based on a driving power generated from a motor (hereinafter referred to as "a feed motor"). The driving power generated from the feed motor is transmitted to the pickup roller 33 via a driving power transmission mechanism. As a result, the rotation of the feed roller 34 also rotates the pickup roller 33. The driving power transmission mechanism typically includes gears.

When sending out a plurality of sheets S from the paper feeder 3, the pickup roller 33 and the feed roller 34 intermittently operate (rotate). In other words, the feed motor repeats driving and a stop of driving. This results in intermittently sending out the plurality of sheets S from the paper feeder 3.

The retard roller 35 is in abutting contact with the feed roller 34 when the pickup roller 33 does not feed out the sheet S. When two or more of the sheets S are fed out in an overlapped state by the pickup roller 33, the retard roller 35 separates the subsequent sheets S from the sheet S that has precedingly reached the feed roller 34. This makes the multi feeding of the sheet S to occur. Specifically, the retard roller 35 prevents a movement of the subsequent sheets S to separate the subsequent sheets S from the preceding sheet S.

In the embodiment, the retard roller 35 is in pressure contact with the feed roller 34. The retard roller 35 is connected to a torque limiter.

When one sheet S is fed out by the pickup roller 33, the retard roller 35 rotates corresponding to the rotation of the feed roller 34. In other words, the retard roller 35 is driven by the rotation of the feed roller 34. This results in sending out of the sheet S. At this time, the torque limiter applies a torque that acts, in a rotation direction opposite to a rotation direction of the feed roller 34, to the feed roller 34. Consequently, a rotation count N of the retard roller 35 becomes less than a rotation count of the feed roller 34.

On the other hand, when two or more of the sheets S are fed out in the overlapped state by the pickup roller 33, the torque acting on the retard roller 35 increases to become a value equal to or more than a set value preliminarily set to the torque limiter. When the torque acting on the retard roller 35 becomes equal to or more than the set value, the torque limiter stops the rotation of the retard roller 35. This results in preventing the movement of the subsequent sheet S by the retard roller 35 and sending out only the preceding sheet S (one sheet S) by the rotation of the feed roller 34.

The rotation-count detection sensor 36 outputs a rotation-count detection signal that indicates the rotation count N of the retard roller 35. The control unit 120 (the processing unit 121) detects the rotation count N of the retard roller 35 based on the rotation-count detection signal. In the following, the processing that detects the rotation count N of the retard roller 35 is described as "rotation-count detection processing."

Subsequently, a description will be given of the rotation-count detection processing according to the embodiment. The rotation-count detection processing is executed in determining whether replacement of the retard roller 35 is necessary or not.

The control unit 120 (the processing unit 121) determines whether replacement of the retard roller 35 is necessary or not based on the detected rotation count N of the retard roller 35. Specifically, the control unit 120 determines that the replacement of the retard roller 35 is necessary when the rotation count N of the retard roller 35 becomes equal to or less than a certain ratio with respect to the rotation count of the feed roller 34. In the embodiment, the control unit 120 causes the feed roller 34 to rotate by a predetermined rotation count and detects the rotation count N of the retard roller 35 during that time.

The control unit 120 determines that the replacement of the retard roller 35 is necessary when the rotation count N of the retard roller 35 is equal to or less than a threshold value. When determining that the replacement of the retard roller 35 is necessary, the control unit 120 causes the display apparatus 22 (see FIG. 1) to display an error notification screen that indicates necessity of the replacement of the retard roller 35. Consequently, the display apparatus 22 functions as a notification device, in the embodiment.

In replacing the retard roller 35, the pickup roller 33 and the feed roller 34 are typically replaced together. Accordingly, the error notification screen may display a message promoting the replacement of the rollers of the paper feeder 3.

Figure 3:
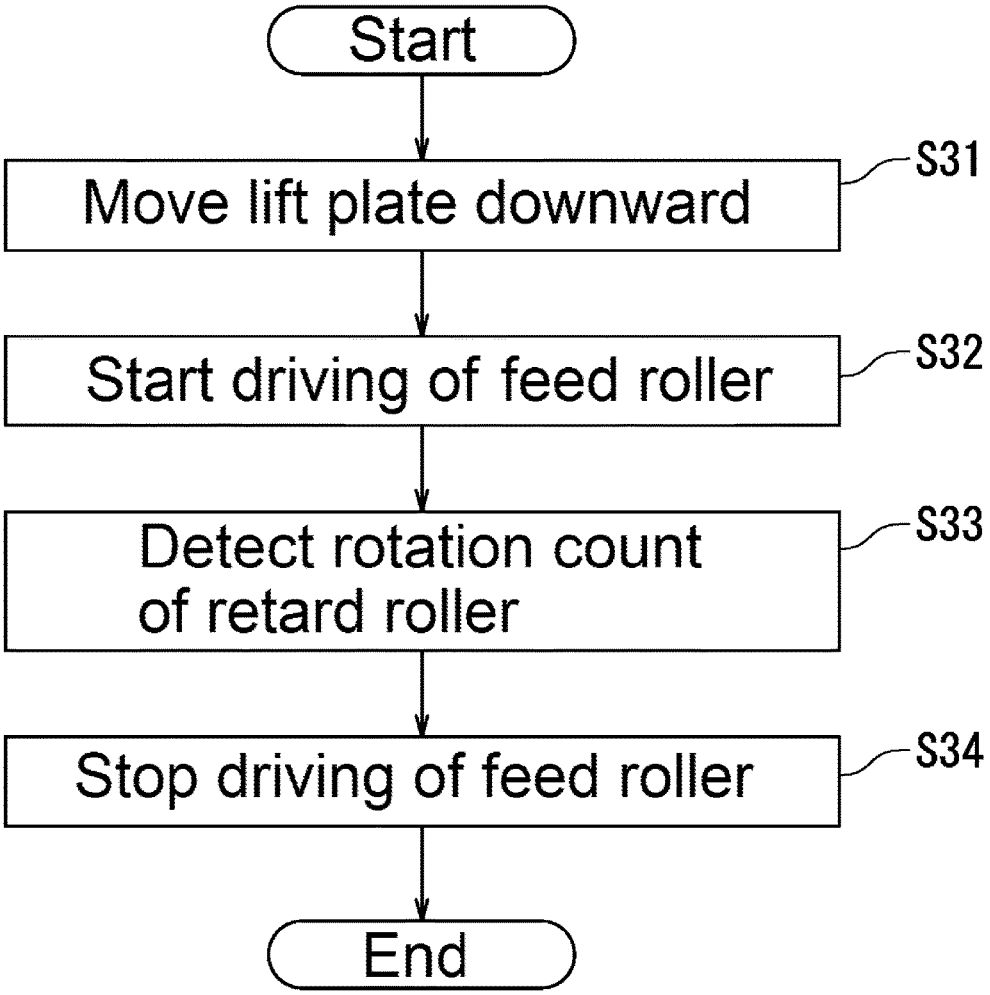
FIG. 3 illustrates rotation-count detection processing according to the embodiment 1.

Subsequently, a description will be further given of the rotation-count detection processing according to the embodiment with reference to FIGS. 1 to 3. FIG. 3 illustrates the rotation-count detection processing according to the embodiment.

The rotation-count detection processing, which is illustrated in FIG. 3, is executed every time a print job terminates. For details, when commanded to execute a print job from an external device, the control unit 120 (the processing unit 121) controls the operations of the respective units of the image forming apparatus 1 such that an image is formed on the sheet S. The control unit 120 determines whether the sheet S (hereinafter referred to as "a last sheet S") on which a last image of a print target is to be printed is sent out from the paper feeder 3 or not, during execution of the print job. Whether the last sheet S is sent out from the paper feeder 3 or not is determined based on the output of the sheet-rear-end detection sensor 9. When determining that the last sheet S is sent out from the paper feeder 3, the control unit 120 starts the rotation-count detection processing.

First, as illustrated in FIG. 3, when determining that the last sheet S is sent out, the control unit 120 moves the lift plate 32 downward to separate the lift plate 32 from the pickup roller 33 (Step S31). That is, the lift plate 32 is separated from the pickup roller 33 before the control unit 120 detects the rotation count N of the retard roller 35. This results in separation of the sheet S from the pickup roller 33. Specifically, the lift motor in the embodiment is a motor rotatable in forward and reverse directions, and the control unit 120 turns the lift plate 32 such that the distal end portion 32*a* of the lift plate 32 is separated from the pickup roller 33. For example, the control unit 120 drives the lift motor for one second to move the distal end portion 32*a* of the lift plate 32 downward. Sending out the last sheet S from the paper feeder 3 stops the driving of the feed motor. Consequently, during the downward movement of the lift plate 32, the pickup roller 33, the feed roller 34, and the retard roller 35 are not driven (rotated).

After moving the lift plate 32 downward, the control unit 120 drives the feed motor to rotate (drive) the feed roller 34 (Step S32). At this time, since separated from the sheet S, the pickup roller 33 does not pick up the sheet S. Consequently, the retard roller 35 is in abutting contact with the feed roller 34. That is, when the control unit 120 detects the rotation count N of the retard roller 35, the retard roller 35 is in abutting contact with the feed roller 34.

When the rotation of the feed roller 34 starts, the control unit 120 detects the rotation count N of the retard roller 35 based on the output of the rotation-count detection sensor 36 (Step S33).

After a predetermined period has passed since the start of the rotation of the feed roller 34, the control unit 120 stops the driving of the feed motor to stop the driving (rotation) of the feed roller 34 and the retard roller 35 (Step S34). Rotating the feed roller 34 for the predetermined period enables rotating the feed roller 34 by a predetermined rotation count. For example, the period (the predetermined period) for rotating the feed roller 34 is two seconds. Rotating the feed roller 34 for two seconds rotates the feed roller 34, for example, five times.

After stopping the rotation of the feed roller 34 and the retard roller 35, the control unit 120 terminates the rotation-count detection processing.

The rotation-count detection processing according to the embodiment has been described above. With the rotation-count detection processing according to the embodiment, the sheet S is not picked up by the pickup roller 33 in detection of the rotation count N of the retard roller 35. Consequently, this ensures prevention of occurrence of a failure that the rotation count N of the retard roller 35 is reduced due to multi feeding of the sheet S. As a result, this ensures stable determination of whether the replacement of the retard roller 35 is necessary or not.

A start timing of the rotation-count detection processing is not limited to the timing when the last sheet S is sent out from the paper feeder 3. For example, the rotation-count detection processing may be executed at every certain period. Alternatively, the rotation-count detection processing may be executed in a maintenance mode. Alternatively, the rotation-count detection processing may be executed when all the sheets S placed on the lift plate 32 are fed out by the pickup roller 33. Specifically, the rotation-count detection processing may be executed when the sheet-rear-end detection sensor 9 does not detect the rear end of the sheet S within a certain period from when the control unit 120 (the processing unit 121) instructs the paper feeder 3 to supply the sheet S. Alternatively, a remaining amount detection sensor that detects a remaining amount of the sheets S inside the cassette 31 may be located in the paper feeder 3. For details, the rotation-count detection processing may be executed when the remaining amount detection sensor outputs a signal that indicates absence of the sheet S inside the cassette 31.

Figure 4:
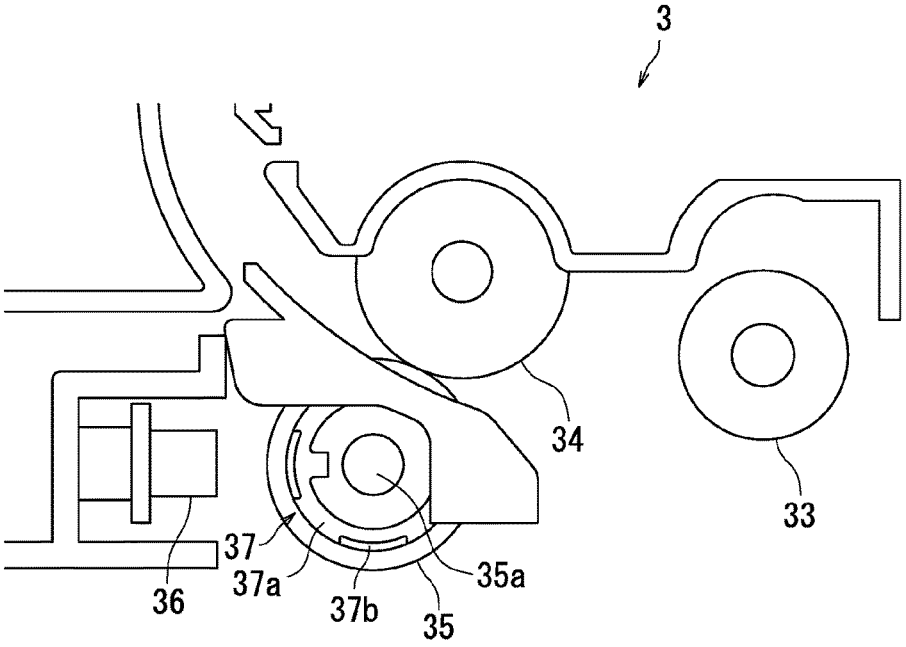
FIG. 4 illustrates a peripheral configuration of a retard roller according to the embodiment 1.
Figure 5:
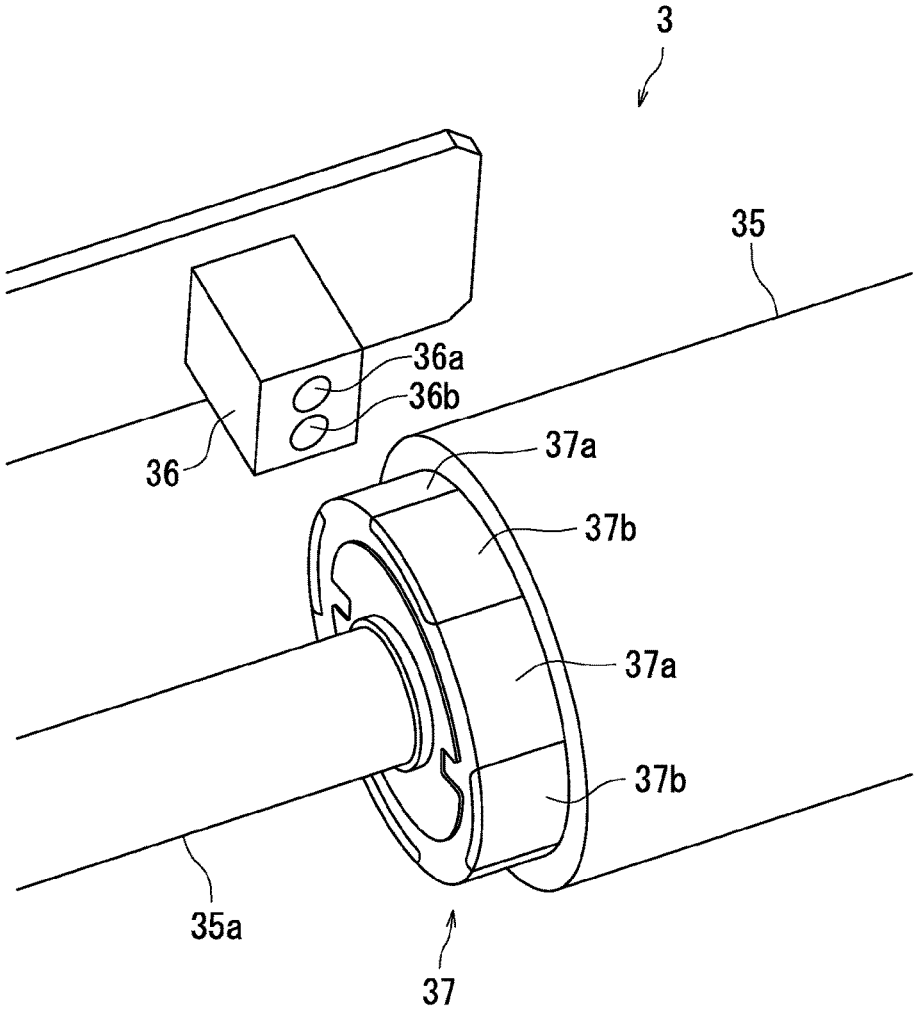
FIG. 5 illustrates the peripheral configuration of the retard roller according to the embodiment 1.

Subsequently, a description will be further given of the paper feeder 3 according to the embodiment with reference to FIGS. 4 and 5. FIGS. 4 and 5 illustrate a peripheral configuration of the retard roller 35 according to the embodiment.

As illustrated in FIGS. 4 and 5, the paper feeder 3 further includes a rotation detection member 37. The rotation detection member 37 rotates together with the retard roller 35, and the rotation-count detection sensor 36 detects the rotation count (rotation count N) of the rotation detection member 37.

The rotation detection member 37 is disk-shaped and is mounted onto one end surface of the retard roller 35. The rotation detection member 37 includes a light absorbing member 37*a* and light reflecting members 37*b*.

In the embodiment, the light absorbing member 37*a* has an annular shape, and a circumference surface of the light absorbing member 37*a* includes a plurality of concave portions. The plurality of concave portions are arranged at approximately equal intervals along a circumferential direction of the light absorbing member 37*a* (the rotation detection member 37). The light reflecting members 37*b* are secured to the concave portions of the light absorbing member 37*a*. As a result, the surface of the light absorbing member 37*a* and the surface of the light reflecting member 37*b* are alternately arranged in the circumference surface of the rotation detection member 37. The circumference surface of the light absorbing member 37*a* may include a plurality of protrusions that are arranged along the circumferential direction. In this case, the light reflecting members 37*b* are arranged between the adjacent protrusions.

Typically, the light absorbing member 37*a* is constituted of a member showing a blackish color, and the light reflecting member 37*b* is constituted of a member showing a whitish color. For example, the light absorbing member 37*a* and the light reflecting member 37*b* are made of resin. Only the circumference surface of the light absorbing member 37*a* may be constituted of a member showing a blackish color. Similarly, only the circumference surface of the light reflecting member 37*b* may be constituted of a member showing a whitish color.

In the embodiment, the rotation-count detection sensor 36 is a reflection type optical sensor and includes a light emitting end 36*a* and a light receiving end 36*b*, as illustrated in FIG. 5. The rotation-count detection sensor 36 is controlled by the control unit 120 (the processing unit 121), which has been described with reference to FIG. 2, to emit a light toward the circumference surface of the rotation detection member 37 from the light emitting end 36*a*. The light reflected from the circumference surface of the rotation detection member 37 enters the light receiving end 36*b*.

At the rotation-count detection processing (Step S33 in FIG. 3), which has been described with reference to FIGS. 1 to 3, the rotation-count detection sensor 36 emits the light toward the circumference surface of the rotating rotation detection member 37. As a result, the signals that indicate the rotation count of the rotation detection member 37 are outputted from the rotation-count detection sensor 36. The output of the rotation-count detection sensor 36 includes typically pulse signals.

The rotation detection member 37 according to the embodiment has been described above. In the embodiment, using the rotation detection member 37 ensures facilitated detection of the rotation count N of the retard roller 35.

The rotation detection member 37 is preferably concentric with the retard roller 35. The rotation detection member 37, which is concentric with the retard roller 35, ensures accurate detection of the rotation count N of the retard roller 35.

The rotation detection member 37 may be mounted to a shaft portion 35*a* of the retard roller 35. In this case, the rotation detection member 37 may be separated from the end surface of the retard roller 35.

Embodiment 2

Subsequently, a description will be given of the embodiment 2 of the disclosure with reference to FIG. 6. The embodiment 2 is different from the embodiment 1 in the processes that determine whether the replacement of the retard roller 35 is necessary or not.

Figure 6:
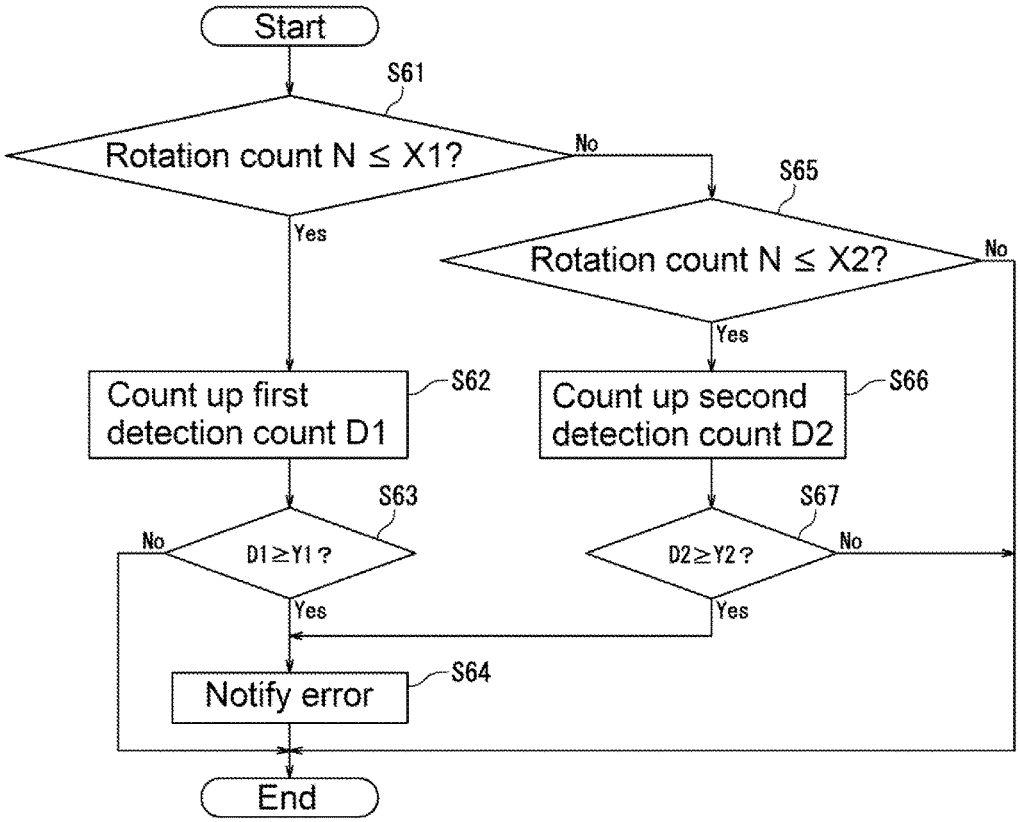
FIG. 6 illustrates processes that determine whether replacement of the retard roller according to an embodiment 2 of the disclosure is necessary or not.

FIG. 6 illustrates the processes that determine whether the replacement of the retard roller 35 according to the embodiment is necessary or not. The processes illustrated in FIG. 6 are started after the execution of the rotation-count detection processing described in the embodiment 1. In other words, detection of the rotation count N of the retard roller 35 causes the processes illustrated in FIG. 6 to start.

As illustrated in FIG. 6, detection of the rotation count N of the retard roller 35 causes the control unit 120 (the processing unit 121) to detect whether the rotation count N of the retard roller 35 is equal to or less than a first rotation-count threshold value $X_1$ or not (Step S61). The first rotation-count threshold value $X_1$ indicates, for example, "2."

When the rotation count N of the retard roller 35 is detected to be equal to or less than the first rotation-count threshold value $X_1$ (Yes at Step S61), the control unit 120 counts up a first detection count $D_1$ (Step S62). An initial value of the first detection count $D_1$ is "0."

After having counted up the first detection count $D_1$, the control unit 120 determines whether the first detection count $D_1$ is equal to or more than a first detection count threshold value $Y_1$ (Step S63). The first detection count threshold value $Y_1$ indicates, for example, "1."

When determining that the first detection count $D_1$ is equal to or more than the first detection count threshold value $Y_1$ (Yes at Step S63), the control unit 120 causes the display apparatus 22 to display the error notification screen that indicates the necessity of the replacement of the retard roller 35 (Step S64) to terminate the processes illustrated in FIG. 6. On the other hand, when determining that the first detection count $D_1$ is not equal to or more than the first detection count threshold value $Y_1$ (No at Step S63), the control unit 120 terminates the processes illustrated in FIG. 6 without causing the display apparatus 22 to display the error notification screen.

When the rotation count N of the retard roller 35 is detected to be not equal to or less than the first rotation-count threshold value $X_1$ (No at Step S61), the control unit 120 detects whether the rotation count N of the retard roller 35 is equal to or less than a second rotation-count threshold value $X_2$ or not (Step S65). The second rotation-count threshold value $X_2$ indicates a value larger than the first rotation-count threshold value $X_1$ ($X_2>X_1$). For example, the second rotation-count threshold value $X_2$ indicates "3."

When the rotation count N of the retard roller 35 is detected to be equal to or less than the second rotation-count threshold value $X_2$ (Yes at Step S65), the control unit 120 counts up a second detection count $D_2$ (Step S66). An initial value of the second detection count $D_2$ is "0."

After counting up the second detection count $D_2$, the control unit 120 determines whether the second detection count $D_2$ is equal to or more than a second detection count threshold value $Y_2$ or not (Step S67). The second detection count threshold value $Y_2$ indicates a value larger than the first detection count threshold value $Y_1$ ($Y_2>Y_1$). For example, the second detection count threshold value $Y_2$ indicates "5."

When determining that the second detection count $D_2$ is equal to or more than the second detection count threshold value $Y_2$ (Yes at Step S67), the control unit 120 causes the display apparatus 22 to display the error notification screen that indicates the necessity of the replacement of the retard roller 35 (Step S64) to terminate the processes illustrated in FIG. 6. On the other hand, when determining that the second detection count $D_2$ is not equal to or more than the second detection count threshold value $Y_2$ (No at Step S67), the control unit 120 terminates the processes illustrated in FIG. 6 without causing the display apparatus 22 to display the error notification screen.

When the rotation count N of the retard roller 35 is detected to be not equal to or less than the second rotation-count threshold value $X_2$ (No at Step S65), the control unit 120 terminates the processes illustrated in FIG. 6 without causing the display apparatus 22 to display the error notification screen.

The embodiment 2 has been described above. This embodiment ensures detection of a state where a jam is highly likely to occur and prompt display of the error notification screen by using the first rotation-count threshold value $X_1$ and the first detection count threshold value $Y_1$. Consequently, accuracy of an error notification (an alarm) is enhanced.

It is preferred that the first rotation-count threshold value $X_1$, the second rotation-count threshold value $X_2$, the first detection count threshold value $Y_1$, and the second detection count threshold value $Y_2$ are settable to any values by operation of the operation panel 2 by an operator. This is because the replacement timing of the retard roller 35 varies corresponding to an installation environment of the image forming apparatus 1 and the kinds of sheets S, which are used.

While in the embodiment two sets of rotation-count threshold values and detection count threshold values are used, three or more sets of rotation-count threshold values and detection count threshold values may be used.

The embodiments of the disclosure have been described above with reference to the drawings. However, the disclosure is not limited to the embodiments described above and may be implemented in various aspects without departing from the gist of the disclosure.

For example, while in the embodiments of the disclosure the control unit 120 of the image forming apparatus 1 detects the rotation count of the retard roller 35 to determine whether the replacement of the retard roller 35 is necessary or not, the disclosure is not limited to this configuration. By locating a control unit in the paper feeder 3, the control unit of the paper feeder 3 may detect the rotation count of the retard roller 35 to determine whether the replacement of the retard roller 35 is necessary or not.

While in the embodiments of the disclosure the image forming apparatus 1 is an electrophotographic-method printer, the disclosure is not limited to this configuration. The disclosure is also applicable to, for example, a copier or a multi-functional peripheral.

While in the embodiments of the disclosure the intermediate-transfer-type image forming apparatus 1 has been described, the disclosure is not limited to this configuration. The disclosure is also applicable to a direct-transfer-type image forming apparatus. The direct-transfer-type image forming apparatus has a configuration that directly transfers a toner image onto a sheet from an image carrier.

While in the embodiments of the disclosure the image forming apparatus 1 that can form a color image has been described, the disclosure is not limited to this configuration. The disclosure is also applicable to an image forming apparatus that can form only a monochrome image.

While in the embodiments of the disclosure the image forming apparatus 1 forms an image by the electrophotographic method, the disclosure is not limited to this configuration. The disclosure is also applicable to, for example, an Inkjet-printing-method image forming apparatus.

While in the embodiments of the disclosure the image forming apparatus 1 obtains image data from an external device, the disclosure is not limited to this configuration. The disclosure is also applicable to an image forming apparatus that includes a scanner.

While in the embodiments of the disclosure the rotation of the retard roller 35 is stopped when the pickup roller 33 feeds out two or more of the sheets S, the disclosure is not limited to this configuration. By locating a motor that rotates the retard roller 35, when the pickup roller 33 feeds out two or more of the sheets S, the retard roller 35 may be rotated to return a subsequent sheet S to the pickup roller 33 side.

While in the embodiments of the disclosure the sheet-rear-end detection sensor 9 is arranged outside the paper feeder 3, the paper feeder 3 may include the sheet-rear-end detection sensor 9. In this case, the sheet-rear-end detection sensor 9 is arranged at a position where separation of the rear end of the sheet S from the feed roller 34 is detected.

While in the embodiments of the disclosure the detection of the rear end of the last sheet S by the sheet-rear-end detection sensor 9 starts the rotation-count detection processing, the disclosure is not limited to this configuration. For example, the rotation-count detection processing may start after an image is formed onto the last sheet S.

While in the embodiments of the disclosure the light reflecting members 37*b* are arranged in the circumference surface of the annular-shaped light absorbing member 37*a*, the disclosure is not limited to this configuration. Light absorbing members 37*a* may be arranged in a circumference surface of an annular-shaped light reflecting member 37*b*.

While in the embodiments of the disclosure the replacement timing of the retard roller 35 is determined using the first rotation-count threshold value $X_1$, the second rotation-count threshold value $X_2$, the first detection count threshold value $Y_1$, and the second detection count threshold value $Y_2$, the disclosure is not limited to this configuration. The replacement timing of the retard roller 35 may be determined using the first rotation-count threshold value $X_1$ and the first detection count threshold value $Y_1$ alone; the replacement timing of the retard roller 35 may be determined using the second rotation-count threshold value $X_2$ and the second detection count threshold value $Y_2$ alone.

The disclosure is useful to a paper feeder including a retard roller.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A paper feeder comprising:

a lift plate that accommodates a plurality of sheets;

a pickup roller that feeds out the plurality of sheets placed on the lift plate one by one;

a feed roller that sends out the sheets that the pickup roller has fed out;

a retard roller that separates a subsequent sheet from the sheet that has precedingly reached the feed roller when two or more of the sheets are fed out in an overlapped state by the pickup roller;

a rotation-count detection sensor that outputs a rotation-count detection signal, the rotation-count detection signal indicating a rotation count of the retard roller; and a control unit that detects the rotation count of the retard roller based on the rotation-count detection signal; wherein the lift plate separates from the pickup roller before the control unit detects the rotation count of the retard roller, the feed roller is driven when the control unit detects the rotation count of the retard roller, the retard roller is in abutting contact with the feed roller when the control unit detects the rotation count of the retard roller, and the control unit determines whether replacement of the retard roller is necessary or not, based on the detected rotation count of the retard roller.

2. The paper feeder according to claim 1, wherein:

during execution of a print job, the control unit determines whether a last sheet has been sent out by the feed roller or not, the last sheet being a sheet on which a last image of a print target is printed;

the lift plate separates from the pickup roller when the control unit determines that the last sheet has been sent out by the feed roller; and the feed roller is driven when the lift plate is separated from the pickup roller.

3. The paper feeder according to claim 1, wherein:

the lift plate separates from the pickup roller when all the sheets placed on the lift plate have been fed out by the pickup roller; and the feed roller is driven when the lift plate separates from the pickup roller.

4. The paper feeder according to claim 1, wherein:

the control unit detects whether the rotation count of the retard roller is equal to or less than a threshold value or not, based on the rotation-count detection signal; and the control unit determines that the replacement of the retard roller is necessary when the rotation count of the retard roller is detected to be equal to or less than the threshold value.

5. The paper feeder according to claim 1, wherein:

the control unit detects whether the rotation count of the retard roller is equal to or less than a first rotation-count threshold value, based on the rotation-count detection signal;

the control unit counts up a first detection count when the rotation count of the retard roller is detected to be equal to or less than the first rotation-count threshold value; and the control unit determines that the replacement of the retard roller is necessary when the first detection count after the count-up is equal to or more than a first detection count threshold value.

6. The paper feeder according to claim 5, wherein:

the control unit detects whether the rotation count of the retard roller is equal to or less than a second rotation-count threshold value or not when the rotation count of the retard roller is detected to be not equal to nor less than the first rotation-count threshold value, the second rotation-count threshold value indicating a value larger than the first rotation-count threshold value;

the control unit counts up a second detection count when the rotation count of the retard roller is detected to be equal to or less than the second rotation-count threshold value; and the control unit determines that the replacement of the retard roller is necessary when the second detection count after the count-up is equal to or more than the second detection count threshold value that indicates a value larger than the first detection count threshold value.

7. The paper feeder according to claim 1, further comprising:

a rotation detection member that rotates together with the retard roller; wherein the rotation-count detection sensor detects the rotation count of the rotation detection member.

8. An image forming apparatus comprising:

a paper feeder that sends out a sheet;

an image forming unit that forms an image on the sheet sent out by the paper feeder; and a control unit that controls the paper feeder and the image forming unit; wherein the paper feeder includes a lift plate that accommodates a plurality of sheets, a pickup roller that feeds out the plurality of sheets placed on the lift plate one by one, a feed roller that sends out the sheets that the pickup roller has fed out, a retard roller that separates a subsequent sheet from the sheet that has precedingly reached the feed roller when two or more of the sheets are fed out in an overlapped state by the pickup roller, and a rotation-count detection sensor that outputs a rotation-count detection signal, the rotation-count detection signal indicating a rotation count of the retard roller;

the lift plate separates from the pickup roller before the control unit detects the rotation count of the retard roller;

the feed roller is driven when the control unit detects the rotation count of the retard roller;

the retard roller is in abutting contact with the feed roller when the control unit detects the rotation count of the retard roller; and the control unit detects the rotation count of the retard roller based on the rotation-count detection signal and determines whether replacement of the retard roller is necessary or not, based on the detected rotation count of the retard roller.

9. The image forming apparatus according to claim 8, further comprising a notification device that notifies that replacement of the retard roller is necessary when the control unit determines that the replacement of the retard roller is necessary.

* * * * *